US008926085B2

(12) United States Patent
Bitoh

(10) Patent No.: US 8,926,085 B2
(45) Date of Patent: Jan. 6, 2015

(54) NAIL PRINT APPARATUS INCLUDING EXTENDABLE LEG

(71) Applicant: Casio Computer Co., Ltd., Shibuya-ku, Tokyo (JP)

(72) Inventor: Hiroyasu Bitoh, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 24 days.

(21) Appl. No.: 13/797,052

(22) Filed: Mar. 12, 2013

(65) Prior Publication Data

US 2013/0242019 A1 Sep. 19, 2013

(30) Foreign Application Priority Data

Mar. 19, 2012 (JP) ..... 2012-061688

(51) Int. Cl.
*A45D 29/00* (2006.01)
*B41J 3/407* (2006.01)

(52) U.S. Cl.
CPC ..... *A45D 29/00* (2013.01); *B41J 3/407* (2013.01); *A45D 2029/005* (2013.01)
USPC ..... 347/104

(58) Field of Classification Search
CPC ..... A45D 29/00; B41J 2/01; B41J 2/04508; B41J 2/17513; B41J 2/1752; B41J 3/36; B41J 3/44; B41J 3/445; B41J 11/0065; B41J 11/007; B41J 11/0085; B41J 11/06; B41J 13/103; B41J 29/02; B41J 29/023; B41J 29/13; B41J 29/38; B41J 2202/09; G02B 5/201; G02F 1/133516
USPC ..... 347/104, 107–109
See application file for complete search history.

(56) References Cited

U.S. PATENT DOCUMENTS

| | | | | |
|---|---|---|---|---|
| 6,035,860 | A * | 3/2000 | Mombourquette | 132/200 |
| 6,286,517 | B1 | 9/2001 | Weber et al. | |
| 6,336,694 | B1 * | 1/2002 | Ishizaka | 347/2 |
| 6,525,724 | B1 | 2/2003 | Takami | |
| 2003/0202083 | A1 * | 10/2003 | Deguchi | 347/108 |
| 2009/0153604 | A1 * | 6/2009 | Chen et al. | 347/9 |
| 2011/0304877 | A1 * | 12/2011 | Bitoh | 358/1.15 |
| 2011/0315027 | A1 * | 12/2011 | Bitoh | 101/35 |

FOREIGN PATENT DOCUMENTS

| | | | |
|---|---|---|---|
| JP | 2000-194838 | A | 7/2000 |
| JP | 2001-030542 | A | 2/2001 |
| JP | 2003-534083 | A | 1/2003 |
| JP | 2012-005666 | A | 1/2012 |
| WO | WO 01/91598 | A1 | 12/2001 |

* cited by examiner

*Primary Examiner* — Manish S Shah
*Assistant Examiner* — Roger W Pisha, II
(74) *Attorney, Agent, or Firm* — Holtz, Holtz, Goodman & Chick PC

(57) ABSTRACT

A nail print apparatus includes a print apparatus body and a leg. The print apparatus body includes a first insertion section having an insertion opening from which a printing finger/toe is inserted, and a print head which performs printing on a nail of the printing finger/toe inserted in the first insertion section. The leg is extendable below the first insertion section and creates a second insertion section in an extended state.

10 Claims, 10 Drawing Sheets

NAIL PRINT APPARATUS INCLUDING EXTENDABLE LEG

BACKGROUND OF THE INVENTION

1. Field of the Invention

The present invention relates to a nail print apparatus including an extendable leg.

2. Description of Related Art

A nail print apparatus is a print apparatus in which the printing fingers having nails to be printed are positioned on a finger placement table provided in an apparatus body and in which images are printed on the nails of the positioned fingers.

Since nail printing includes not only printing on fingernails (i.e., manicure) but also printing on toenails (i.e., pedicure), it is preferable that one apparatus can perform nail printing on both fingernails and toenails.

Japanese Unexamined Patent Application Publication (Translation of PCT Application) No. 2003-534083 proposes a nail print apparatus which includes a plurality of holders for fingers (including a thumb) and toes to maintain nails at appropriate positions. A holder to be used can be selected from the holders in accordance with fingers/toes to be printed.

Such an apparatus can perform nail printing on both fingernails and toenails.

A nail print apparatus which includes a plurality of selectable holders as disclosed in the above-mentioned document, however, results in an increase in the number of components constituting the apparatus. This may cause confusion for a user and may cause an accident due to improper use and is inconvenient for storage. In addition, if an apparatus includes a plurality of holders detachable from an apparatus body, there is a risk of loss of a holder.

In a conventional nail print apparatus, a printing finger insertion section where fingers with printing-target nails (i.e., printing fingers) are inserted is provided near a print head, and a space is provided below the printing finger insertion section. In this space, non-printing fingers for which nail printing is not performed are inserted. The non-printing fingers include fingers with nails which are to be printed in the printing finger insertion section but have not yet been printed, fingers with nails which have already been printed in the printing finger insertion section, and fingers with nails which are not to be printed in the printing finger insertion section. Thus, a conventional nail print apparatus is designed so that printing fingers can be comfortably placed below a print head.

Such a nail print apparatus, however, is not meant to perform nail printing on toenails, and a printing finger insertion section thereof is disposed high above a floor.

Therefore, in performing nail printing on toenails with such a conventional apparatus, a user has difficulty in inserting toes into the printing finger insertion section; or even when the user can insert the toes therein, he/she cannot fully fix the toes because his/her heel is not on the floor which causes the foot to move or shake.

In addition, if a partition member provided between the printing finger insertion section and the space for non-printing fingers is not strong enough, the apparatus may get broken by a great force applied thereto when the toes are inserted into the printing finger insertion section.

SUMMARY OF THE INVENTION

The present invention, which is made in view of the above problems, provides a nail print apparatus that perform nail printing on both fingernails and toenails with a simple structure without increasing the number of components.

According to an aspect of the present invention, there is provided a nail print apparatus including: a print apparatus body including: a first insertion section having an insertion opening from which a printing finger/toe is inserted, and a print head which performs printing on a nail of the printing finger/toe inserted in the first insertion section; and a leg which is extendable below the first insertion section and creates a second insertion section in an extended state.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein.

DETAILED DESCRIPTION OF THE PREFERRED EMBODIMENTS

First Embodiment

Figure 1:
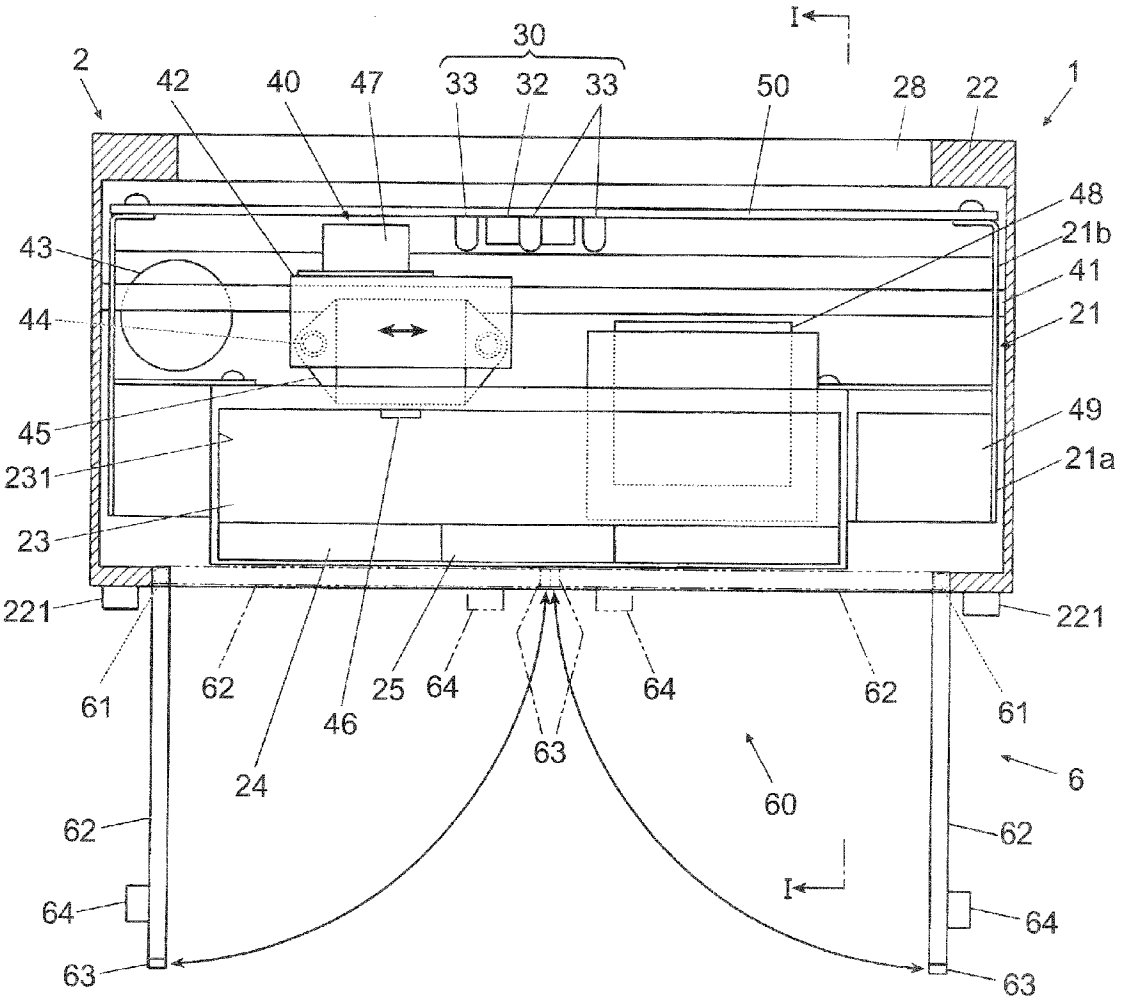
FIG. 1 is a schematic cross-sectional view illustrating the internal structure, viewed from the front, of a nail print apparatus according to a first embodiment.

First, a first embodiment of a nail print apparatus according to the present invention is described with reference to FIGS. 1 to 8. The embodiment described below has various features which are technically preferable to carry out the present invention. The scope of the present invention, however, is not limited to the embodiment below and the example shown in the drawings.

Figure 2:
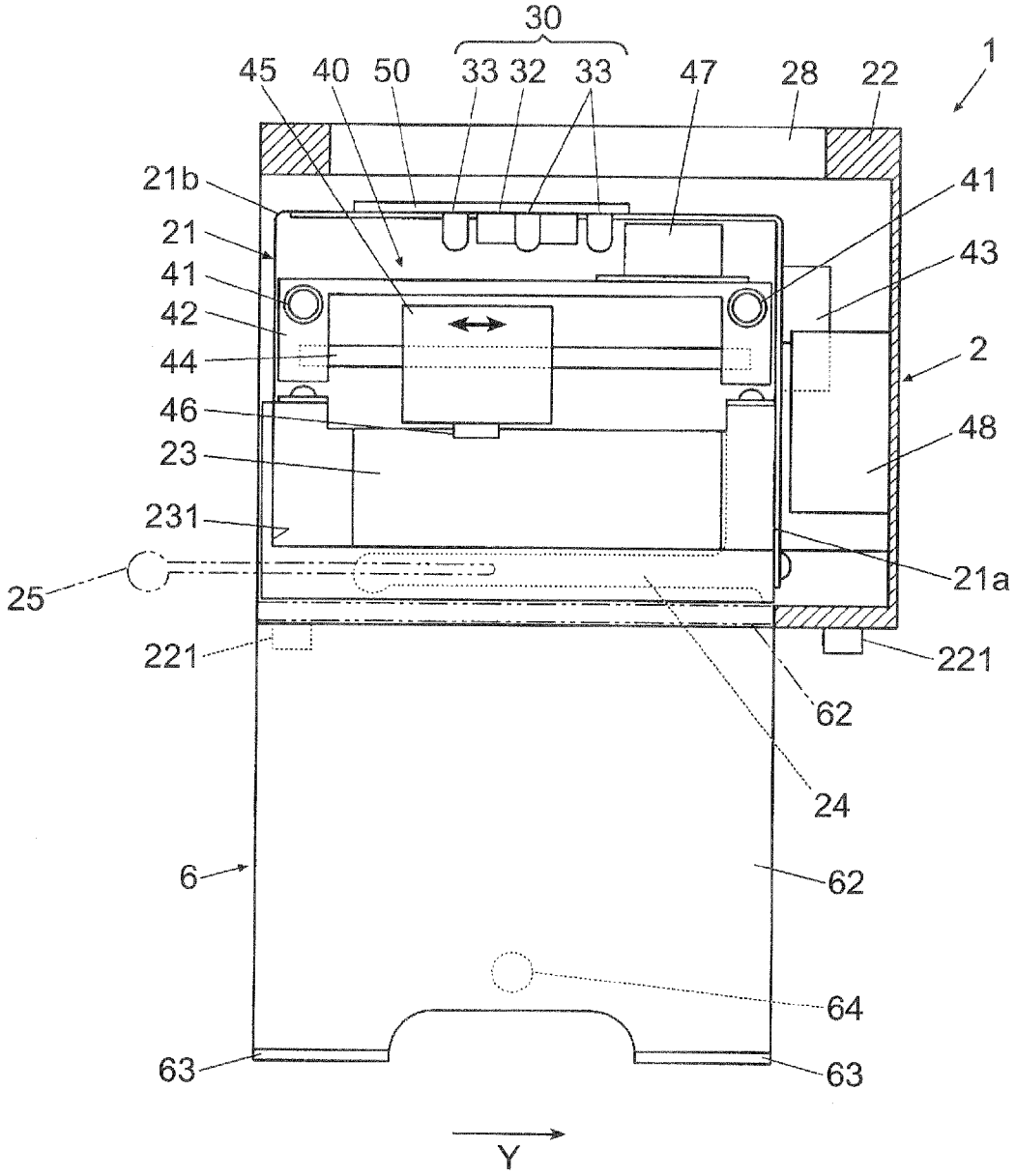
FIG. 2 is a cross-sectional view, along the line I-I, of the nail print apparatus shown in FIG. 1 according to the first embodiment.

FIG. 1 is a schematic cross-sectional view, viewed from the front, of a nail print apparatus 1 according to the first embodiment; and FIG. 2 is a cross-sectional view, viewed from a side, of the nail print apparatus 1 shown in FIG. 1. Each of FIGS. 1 and 2 shows the internal structure of the nail print apparatus 1 with a part of a case 22 removed.

As shown in FIGS. 1 and 2, the nail print apparatus 1 includes a print apparatus body 2 and legs 6.

The print apparatus body 2 includes a machine casing 21 and a case 22 containing the machine casing 21. The shape and the structure of the print apparatus body 2 are not limited to the example shown in the drawings. The case 22, for example, may include a lid to cover the top thereof.

The machine casing 21 is constituted of a lower machine casing 21*a* disposed at the lower part in the case 22, and an upper machine casing 21*b* disposed above the lower machine casing 21*a* and at the upper part in the case 22.

The lower machine casing 21*a* includes a printing finger/toe insertion section 23 (first insertion section) almost in the center of the lower machine casing 21*a* in the width direction (i.e., the lateral direction of FIG. 1) of the nail print apparatus 1. The printing finger/toe insertion section 23 is a section where fingers/toes (printing fingers/toes, hereinbelow) U1 with nails T on which printing is performed are inserted. The printing finger/toe insertion section 23 has an insertion opening 231 from which the printing fingers/toes U1 are inserted at the front side of the nail print apparatus 1.

In the present embodiment, the printing fingers/toes U1 indicate five fingers (i.e., a thumb and index, middle, ring and little fingers) and five toes, as described later. The printing finger/toe insertion section 23 is wide and high enough to contain any of the fingers and toes.

The bottom of the printing finger/toe insertion section 23 serves as a printing finger/toe holder 24 on which the printing fingers/toes U1 inserted in the printing finger/toe insertion section 23 is placed. Photographing and printing of the printing fingers/toes U1 is carried out in a state where the printing fingers/toes U1 are placed on the printing finger/toe holder 24. The shape and the like of the printing finger/toe holder 24 are not limited to the example shown in the drawings.

In the present embodiment, as shown in FIGS. 2, 5, 6 and 7, the end, closer to the insertion opening 231 than the other end, of the printing finger/toe holder 24 is positioned at the back of the insertion opening 231 in the direction into which the printing fingers/toes U1 are inserted (finger/toe insertion direction Y, hereinbelow). Accordingly, when a thumb or five toes are inserted deep into the printing finger/toe insertion section 23 as printing fingers/toes U1, the nails T of the printing fingers/toes U1 are disposed at positions suitable for printing (i.e., positions to allow the nails T to be disposed under the print head 46 described later.

An auxiliary holder 25 is provided almost in the center of the printing finger/toe holder 24 in its width direction (i.e., the lateral direction in FIG. 2). The auxiliary holder 25 can be pulled out of the printing finger/toe holder 24 to project in the direction opposite to the finger/toe insertion direction Y.

The auxiliary holder 25 can be in a stored state where the auxiliary holder 25 and the printing finger/toe holder 24 overlap each other, and can be in a projecting state where the auxiliary holder 25 projects in the direction opposite to the finger/toe insertion direction Y.

In the present embodiment, when performing printing on the nails T of index, middle, ring and little fingers, the auxiliary holder 25 is in the projecting state where the auxiliary holder 25 projects in the direction opposite to the finger/toe insertion direction Y. In this state, the nails T of the printing fingers/toes U1 are disposed at positions suitable for printing when the index, middle, ring and little fingers are inserted deep into the printing finger/toe insertion section 23 until the bases U3 of a thumb and the other fingers touch the front-side end of the auxiliary holder 25 (see FIG. 6).

Figure 3A:
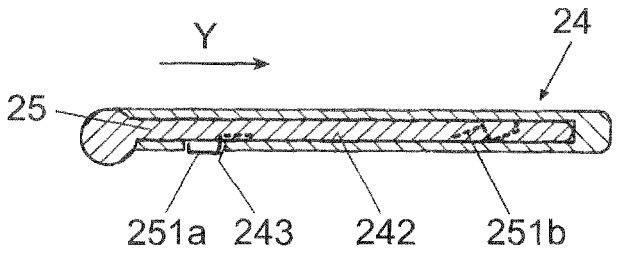
FIG. 3A is a cross-sectional view of a printing finger/toe holder of the present embodiments.
Figure 3B:
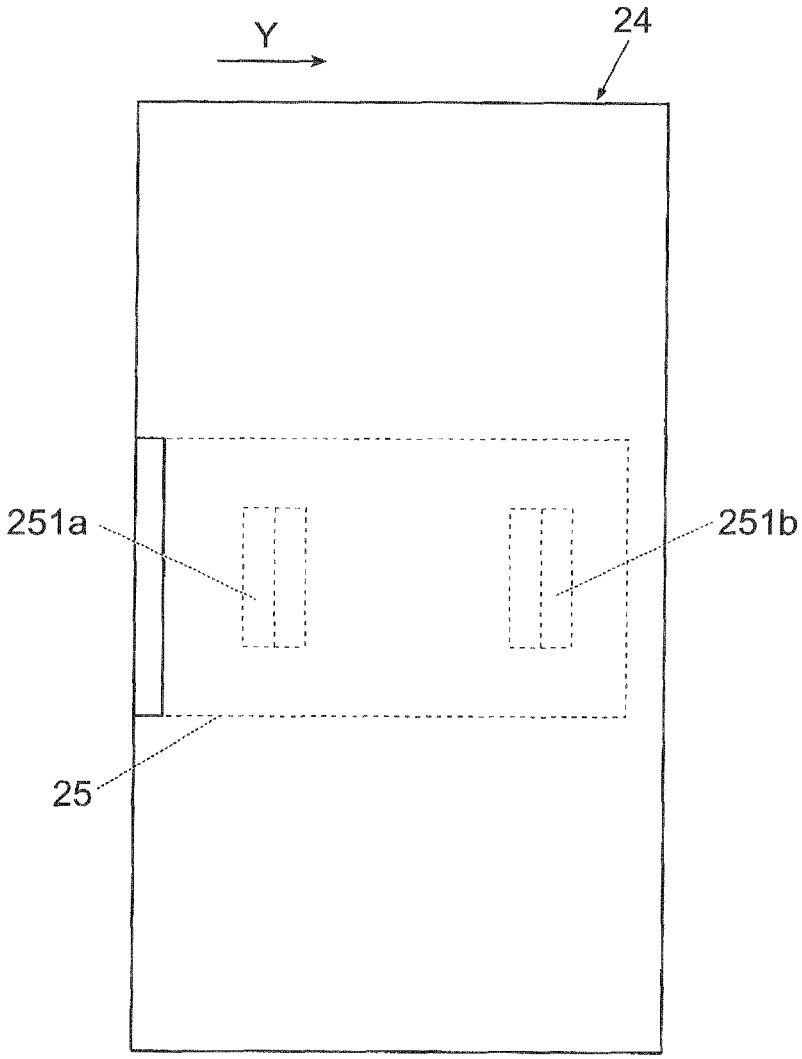
FIG. 3B is a plan view, viewed from the above, of the printing finger/toe holder shown in FIG. 3A.
Figure 4A:
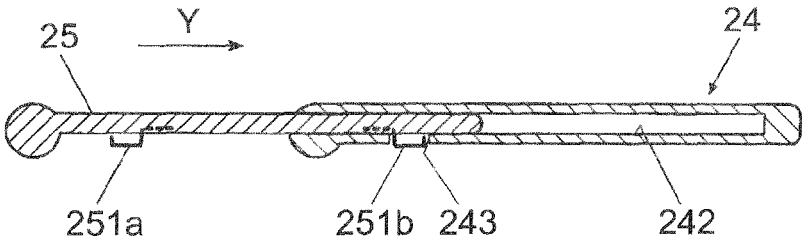
FIG. 4A is a cross-sectional view illustrating the state where an auxiliary holder is pulled out of the printing finger/toe holder of FIGS. 3A and 3B.
Figure 4B:
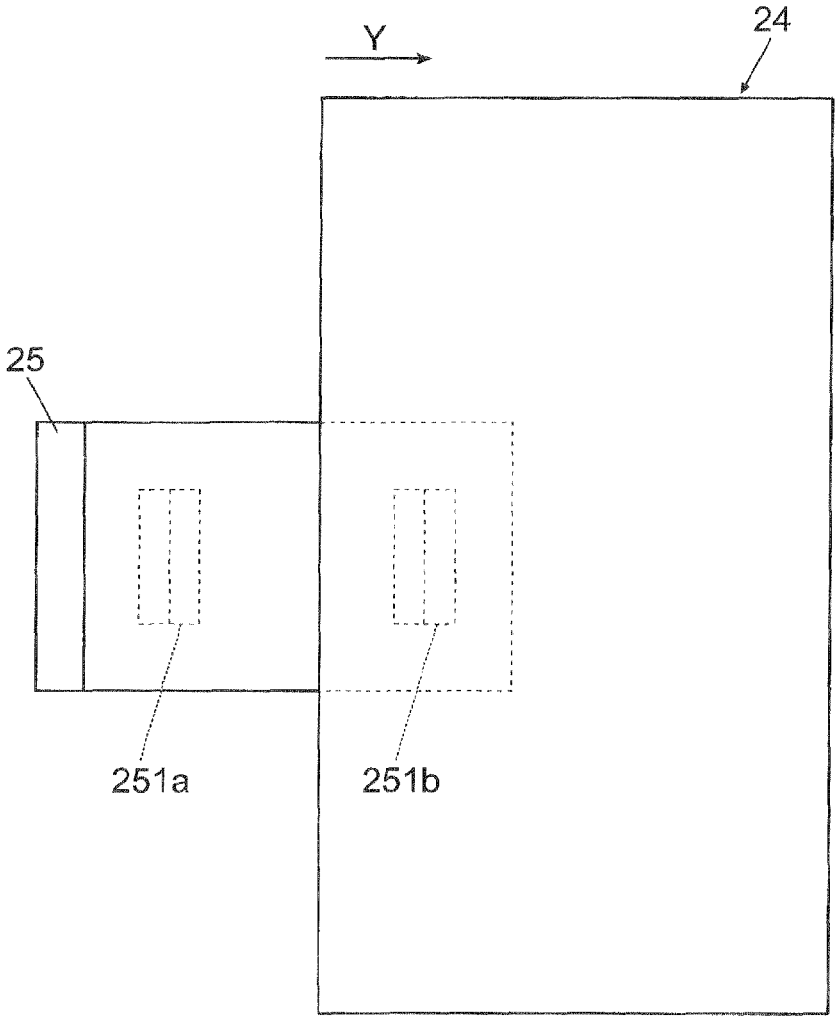
FIG. 4B is a plan view, viewed from the above, of the printing finger/toe holder and the auxiliary holder of FIG. 4A.

FIG. 3A is a sectional side view of the printing finger/toe holder 24 with the auxiliary holder 25 being in the stored state. FIG. 3B is a plan view, viewed from the above (i.e., from above the nail print apparatus 1), of the printing finger/toe holder 24. FIG. 4A is a sectional side view of the printing finger/toe holder 24 with the auxiliary holder 25 being in the projecting state. FIG. 4B is a plan view, viewed from the above (i.e., from above the nail print apparatus 1), of the printing finger/toe holder 24.

As shown in FIGS. 3A, 3B, 4A and 4B, an auxiliary holder storage 242 which is a space to store the auxiliary holder 25 is provided in the printing finger/toe holder 24 almost in the center thereof in its width direction. The auxiliary holder storage 242 has a locking hole 243 near its end on the back side thereof (i.e., the lower side of FIGS. 3A and 4A). The auxiliary holder 25 has locking projections 251*a* and 251*b* near its both ends, respectively. Specifically, the locking projection 251*a* is provided near the forward end of the auxiliary holder 25 in the direction in which the auxiliary holder 25 is pulled out (i.e., the direction in which the auxiliary holder 25 projects); and the locking projection 251*b* is provided near the other end of the auxiliary holder (i.e., the forward end in the finger/toe insertion direction Y). The locking projections 251*a* and 251*b* are elastic members such as leaf springs. As shown in FIGS. 3A and 3B, in the stored state where the auxiliary holder 25 is stored within the auxiliary holder storage 242, the locking projection 251*a* of the auxiliary holder 25 fits in the locking hole 243 of the auxiliary holder storage 242 to maintain the stored state.

As shown in FIG. 4A and FIG. 4B, in the projecting state where the auxiliary holder 25 is pulled out of the auxiliary holder storage 242, the locking projection 251*b* fits in the locking hole 243 so that the auxiliary holder 25 may not fall off the auxiliary holder storage 242 or may not be pulled back into the auxiliary holder storage 242.

The shape, size and structure of the auxiliary holder 25 and the structure to lock the auxiliary holder 25 are not limited to the example described above. The auxiliary holder 25 may be constructed in any way as long as the auxiliary holder 25 can be in the stored state where the auxiliary holder 25 and the printing finger/toe holder 24 overlap each other, and can be in the projecting state where the auxiliary holder 25 projects in the direction opposite to the finger/toe insertion direction Y. For example, the auxiliary holder 25 may be rotatably attached to the front-side end of the printing finger/toe holder 24 such that the auxiliary holder 25 is folded to overlap the printing finger/toe holder 24 in the stored state.

As shown in FIGS. 1 and 2, the machine casing 21 includes a substrate 50 provided with a photographing section 30, a print section 40 and a control device as a control section (not shown).

The photographing section 30 is provided on the upper machine casing 21*b* of the machine casing 21. The photographing section 30 photographs printing fingers/toes U1 and the nails T thereon inserted in the printing finger/toe insertion section 23 to obtain the image data of the printing fingers/toes U1 and the nails T.

A camera 32 having about two million pixels or more and including a built-in driver is disposed at the center of the lower surface of the substrate 50 disposed on the upper machine casing 21*b*. In addition, lights 33 such as white LEDs are disposed on the substrate 50 in such a way as to surround the camera 32. The photographing section 30 includes the camera 32 and the lights 33.

The photographing section 30 illuminates printing fingers/toes U1 with the lights 33, and photographs the printing fingers/toes U1 with the camera 32, so as to obtain images of the printing fingers/toes U1. The photographing section 30 is connected to the control device to be controlled by the control device.

The print section 40 is mainly disposed in the upper machine casing 21*b*. The print section 40 performs printing on the nails T of printing fingers/toes U1 inserted in the printing finger/toe insertion section 23.

As shown in FIGS. 1 and 2, two guide rods 41 are bridged in parallel between two sideboards of the upper machine casing 21*b*. A main carriage 42 is attached to the guide rods 41 in such a way as to slide thereon. As shown in FIG. 2, two guide rods 44 are bridged in parallel between a front wall 42*a* and a back wall 42*b* of the main carriage 42. A secondary carriage 45 is attached to the guide rods 44 in such a way as to slide thereon. The print head 46 is mounted on the secondary carriage 45 at the center of the lower surface thereof.

In the present embodiment, the print head 46 is an inkjet print head which makes ink fine droplets, and directly sprays the fine droplets to target nails T. The recording method of the print head 46 is not limited to the inkjet method.

The main carriage 42 is connected to a motor 43 via a power transmitting section (not shown), and moves in the right-left direction along the guide rods 41 by forward-reversal rotation of the motor 43. The secondary carriage 45 is connected to a motor 47 via a power transmitting section (not shown), and moves in the front-back direction along the guide rods 44 by forward-reversal rotation of the motor 47. In the present embodiment, the range of motion of the print head 46 is the range to be printed by the nail print apparatus 1, and printing for printing fingers/toes U1 is performed within this range.

An ink cartridge 48 which supplies ink to the print head 46 is disposed outside of the machine casing 21 and in the back part of the nail print apparatus 1. The ink cartridge 48 is connected to the print head 46 via an ink supply tube (not shown), and supplies ink to the print head 46 as needed. The ink cartridge 48 may be formed integrally with the print head 46, instead of being formed separately from the print head 46.

A head maintenance mechanism 49 to maintain the print head 46 is disposed at the side of the printing finger/toe insertion section 23 in the lower machine casing 21*a*. The head maintenance mechanism 49 includes a cap to cover the ink ejection surface of the print head 46 to prevent drying and clogging thereof, a waste ink absorber to absorb ink ejected from the print head 46 for non-printing purpose at the time of maintenance of the print head 46 or before a start of printing, and a rubber spatula to clean the surface of the print head 46.

The positions of the ink cartridge 48 and the head maintenance mechanism 49 are not limited to the example described above.

The print section 40 includes the guide rods 41, the main carriage 42, the motor 43, the guide rods 44, the secondary carriage 45, the print head 46, the motor 47, the ink cartridge 48 and the head maintenance mechanism 49.

The motor 43, the print head 46 and the motor 47 of the print section 40 are connected to the control device to be controlled by the control device.

The control device provided on the substrate 50 is a computer including a control section constituted of a not-shown central processing section (CPU), and a storage section constituted of a read only memory (ROM) and a random access memory (RAM) (all not shown). The ROM contains various programs such as a printing program and various pieces of data such as data of design images to be printed on nails T. The control section executes the programs to control each section.

An operation section (not shown) is disposed on the upper surface (top board) of the case 22.

The operation section is an input section to receive various inputs from a user.

The operation section includes an electrical power switch button to power on the nail print apparatus 1, a stop switch button to stop its operation, a design selection button to select a design image to be printed on nails T, a print start button to instruct start of printing, and operation buttons for other various inputs.

In the present embodiment, a display section 28 displays a design selection screen (not shown) for selecting a design image, for example. A design image to be printed is selected when a user selects a desired design image with the design selection button.

The display section 28 is disposed on the top board, almost in its center, of the case 22.

The display section 28 is constituted of a liquid crystal display (LCD), an organic electroluminescence display (organic EL), or another flat-panel display. In the present embodiment, the display section 28 appropriately displays images obtained by photographing printing fingers/toes U1 (hereinafter referred to as a "finger/toe image"), the outlines of nails T included in the finger/toe image, the outlines of fingers/toes in the finger/toe image, a design selection screen for selecting images to be printed on nails T (i.e., design images), thumbnail images for checking designs, an instruction screen to provide various instructions, a notice screen, a warning screen and the like.

A touch panel may be integrally formed on the surface of the display section 28. In this case, various inputs can be performed by touching the surface of the display section 28 too, namely, by touch operations with a stylus pen, a finger tip or the like (not shown).

On the bottom surface of the case 22, shock-absorption members 221 made of resin or the like are provide to prevent a desk or a floor from being damaged when the nail print apparatus 1 is placed on the desk or the floor. These shock-absorption members 221 also serve as non-slip members to prevent the nail print apparatus 1 from moving when printing fingers/toes U1 and non-printing fingers U2 are inserted in or pulled out of the apparatus 1 at the time of printing. The positions at which the shock-absorption members 221 are provided are not limited to the example shown in the drawings. In addition, providing the shock-absorption members 221 is optional and may be omitted.

The legs 6 are disposed at the bottom of the print apparatus body 2 (i.e., the bottom of the case 22 in the present embodiment).

The legs 6 can be folded up into the print apparatus body 2 to be stored thereat (hereinafter, this state is referred to as an "unextended state") and can be extended below the printing finger/toe insertion section 23 (hereinafter, this state is referred to as an "extended state"). A space is created below the printing finger/toe insertion section 23 in the extended state, and this space constitutes a second insertion section 60 where the fingers with non-printing nails T are inserted. Here, the "fingers with non-printing nails T" include at least one of a finger with a nail T which is to be printed in the printing finger/toe insertion section 23 but has not yet been printed, a finger with a nail T which has already been printed in the printing finger/toe insertion section 23, and a finger with a nail T which is not to be printed in the printing finger/toe insertion section 23. Such fingers are hereinafter referred to as "non-printing fingers U2".

The legs 6 include a pair of leg plates 62 whose ends (one end of each of the leg plates 62) are attached near both sides of the bottom of the case 22 with hinges 61. The leg plates 62 are fold-up plates which are rotatable about the hinges 61 as indicated by the arrows as shown in FIG. 1. That is, the legs 6 can be in the unextended state where the legs 6 are substantially parallel with the bottom of the case 22, and can be in the extended state where the legs 6 extend in the direction perpendicular to the bottom of the case 22. It is preferable that the hinges 61 be provided with stopper mechanisms (not shown) which allow the legs 6 to be locked at the positions of the unextended and extended states.

The length of the leg plates 62 in the height direction in the extended state is larger than the width of the sum of index, middle, ring and little fingers of a standard adult. A space is created between the pair of leg plates 62 in the extended state, and this space constitutes the second insertion section 60 where non-printing fingers U2 are inserted.

In the present embodiment, the case 22 has a recess or an opening in its bottom to store the leg plates 62. In the unextended state, the leg plates 62 are folded up into the recess or the opening such that the leg plates 62 lie almost in the same plane as the bottom of the case 22. The structure of the bottom of the case 22 is not limited to the example described here, and the recess or the opening may be omitted.

A shock-absorption member 63 made of resin or the like is provided on the free end each leg plate 62. A shock-absorption member 64, which is also made of resin or the like, is provided on the lateral surface of each leg plate 62. In other words, the shock-absorption members 64 are provided on the surface constituting the bottom surface of the nail print apparatus 1 when the legs 6 are in the unextended state. Providing the shock-absorption members 63 and 64 on the free ends of the leg plates 62 and the lateral surfaces of the leg plates 62, respectively, can prevent a desk or a floor from being damaged by the nail print apparatus 1 in both the unextended state and the extended state. Further, these shock-absorption members 63 and 64 also serve as non-slip members to prevent the nail print apparatus 1 from moving when printing fingers/toes U1 and non-printing fingers U2 are inserted in or pulled out of the apparatus 1 at the time of printing. The positions at which the shock-absorption members 63 and 64 are provided are not limited to the example shown in the drawings. In addition, providing the shock-absorption members 63 and 64 is optional and may be omitted.

Figure 5:
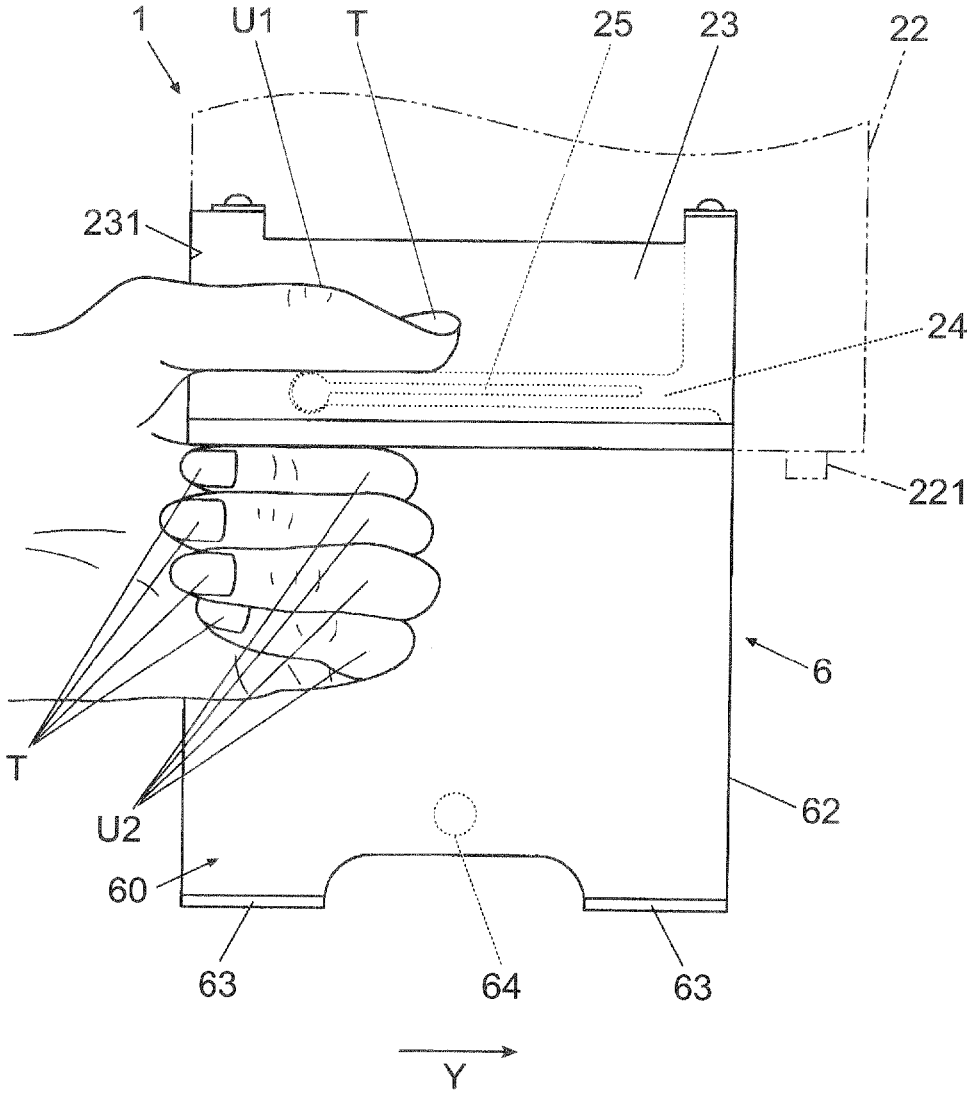
FIG. 5 is a schematic side view of a printing finger/toe insertion section and a second insertion section of the nail print apparatus of FIG. 1, and illustrates the fixing state where a thumb as a printing finger/toe is inserted in the printing finger/toe insertion section.
Figure 6:
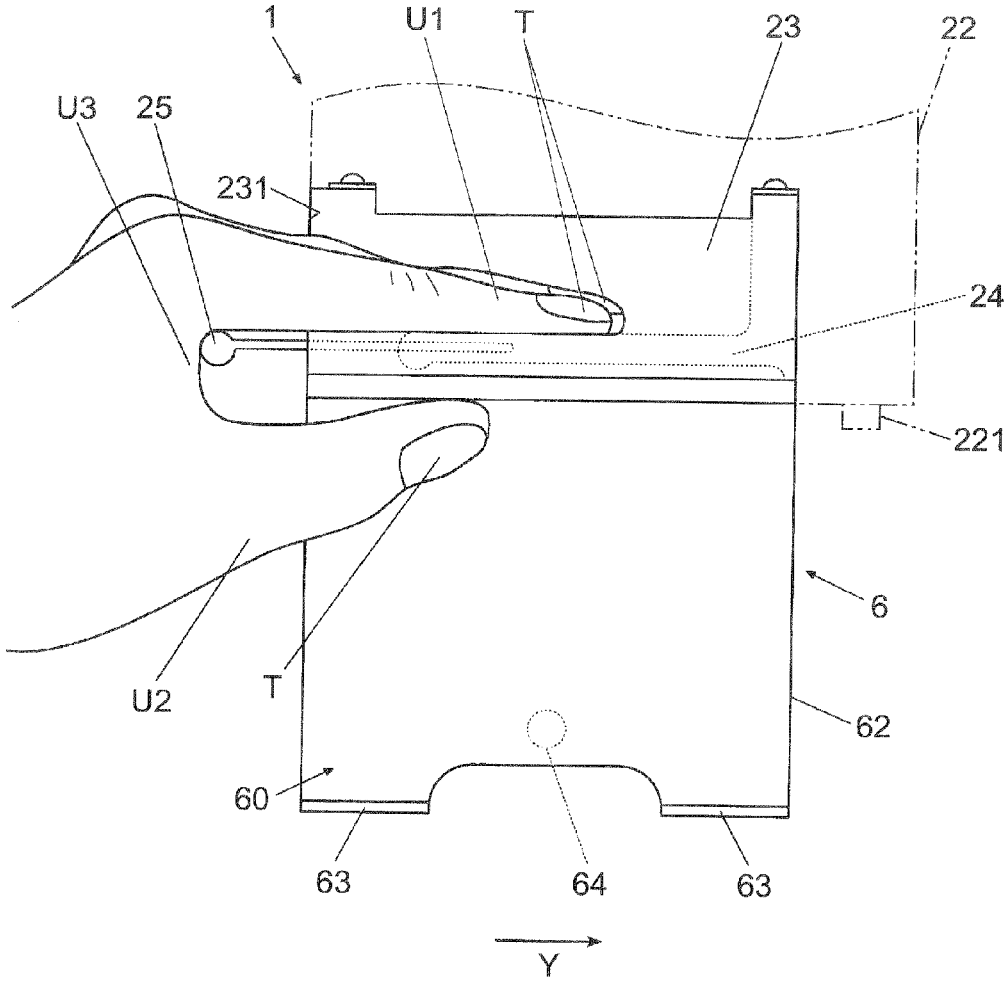
FIG. 6 is a schematic side view of the printing finger/toe insertion section and the second insertion section of the nail print apparatus of FIG. 1, and illustrates the fixing state where index, middle, ring and little fingers as printing fingers/toes are inserted in the printing finger/toe insertion section.
Figure 7:
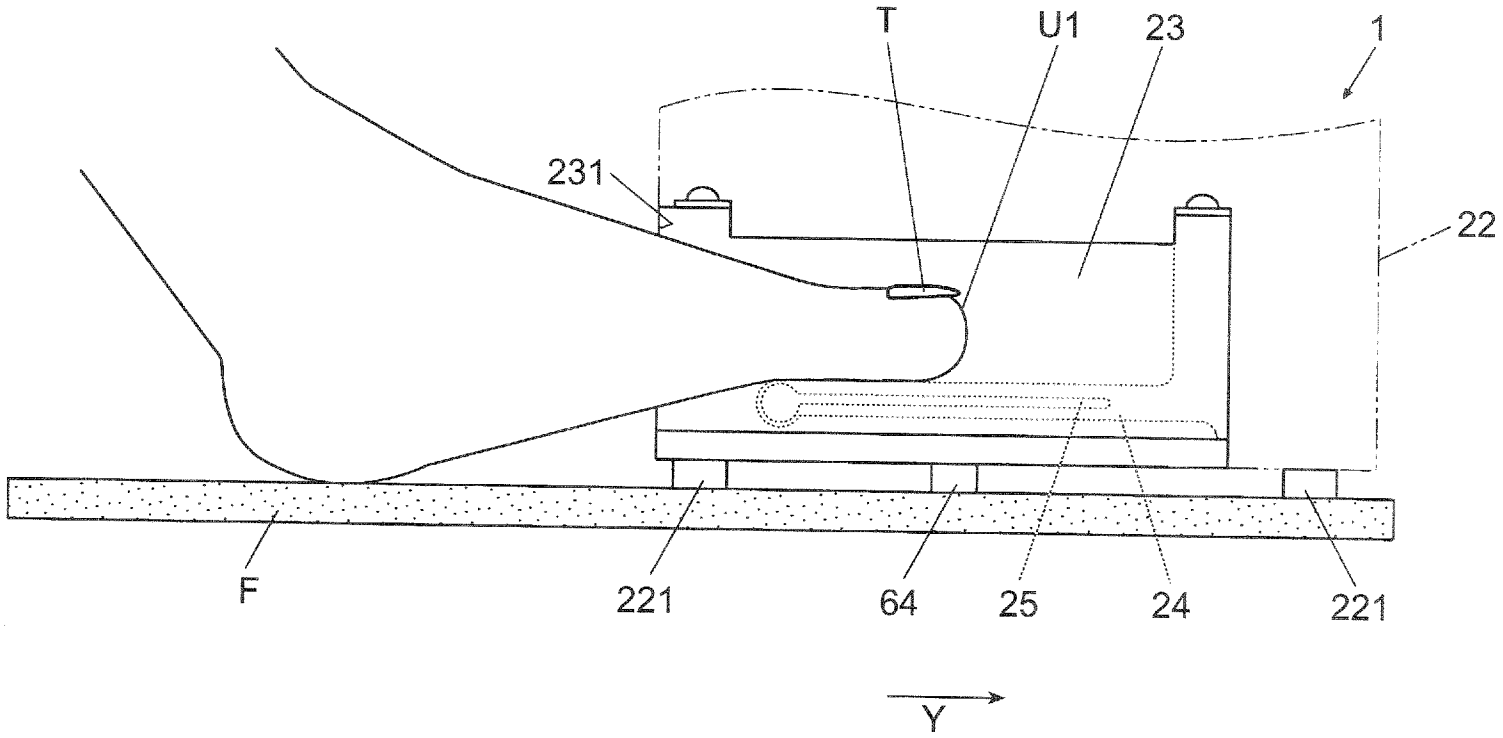
FIG. 7 is a schematic side view of the printing finger/toe insertion section of the nail print apparatus of FIG. 1, and illustrates the fixing state where five toes as printing fingers/toes are inserted in the printing finger/toe insertion section.

Next, the behavior of the nail print apparatus 1 in the present embodiment is described with reference to FIGS. 5 to 8. FIGS. 5 to 7 schematically illustrate the internal structure of the printing finger/toe insertion section 23 and the second insertion section 60 viewed from the side thereof.

In performing printing on nails T of fingers with the nail print apparatus 1, a user rotates the hinges 61 of the legs 6 first to rotate the pair of leg plates 62 outward to put the legs 6 into the extended state, as shown in FIGS. 5 and 6. This creates a space below the printing finger/toe insertion section 23, which space constitutes the second insertion section 60 where non-printing fingers U2 are inserted.

To start printing, the electrical power switch button is turned on to start up the control device. Then, a design image to be printed on nails T is selected and various settings are made, if needed, about which and how many fingers are to be printed.

In printing a design image on the nail T of a thumb, for example, the thumb is inserted as a printing finger/toe U1 into the printing finger/toe insertion section 23 from the insertion opening 231 of the nail print apparatus 1, with the auxiliary holder 25 stored in the printing finger/toe holder 24 as shown in FIG. 5. Further, the four fingers other than the thumb (i.e., the index, middle, ring and little fingers) are inserted as non-printing fingers U2 into the second insertion section 60 created with the legs 6 being in the extended state. In this state, the print section 40 performs printing operation to print the design image on the nail T of the thumb.

In printing a design image on the nails T of index, middle, ring and little fingers, for example, the auxiliary holder 25 is pulled out of the printing finger/toe holder 24 and fixed thereat. And then, the four fingers are inserted as printing fingers/toes U1 into the printing finger/toe insertion section 23 from the insertion opening 231 of the nail print apparatus 1, as shown in FIG. 6. Further, the finger other than the printing fingers/toes U1 (i.e., the thumb) is inserted as a non-printing finger U2 into the second insertion section 60 created with the legs 6 being in the extended state. In this state, the print section 40 performs printing operation to print the design image on the nails T of the four fingers.

Figure 8:
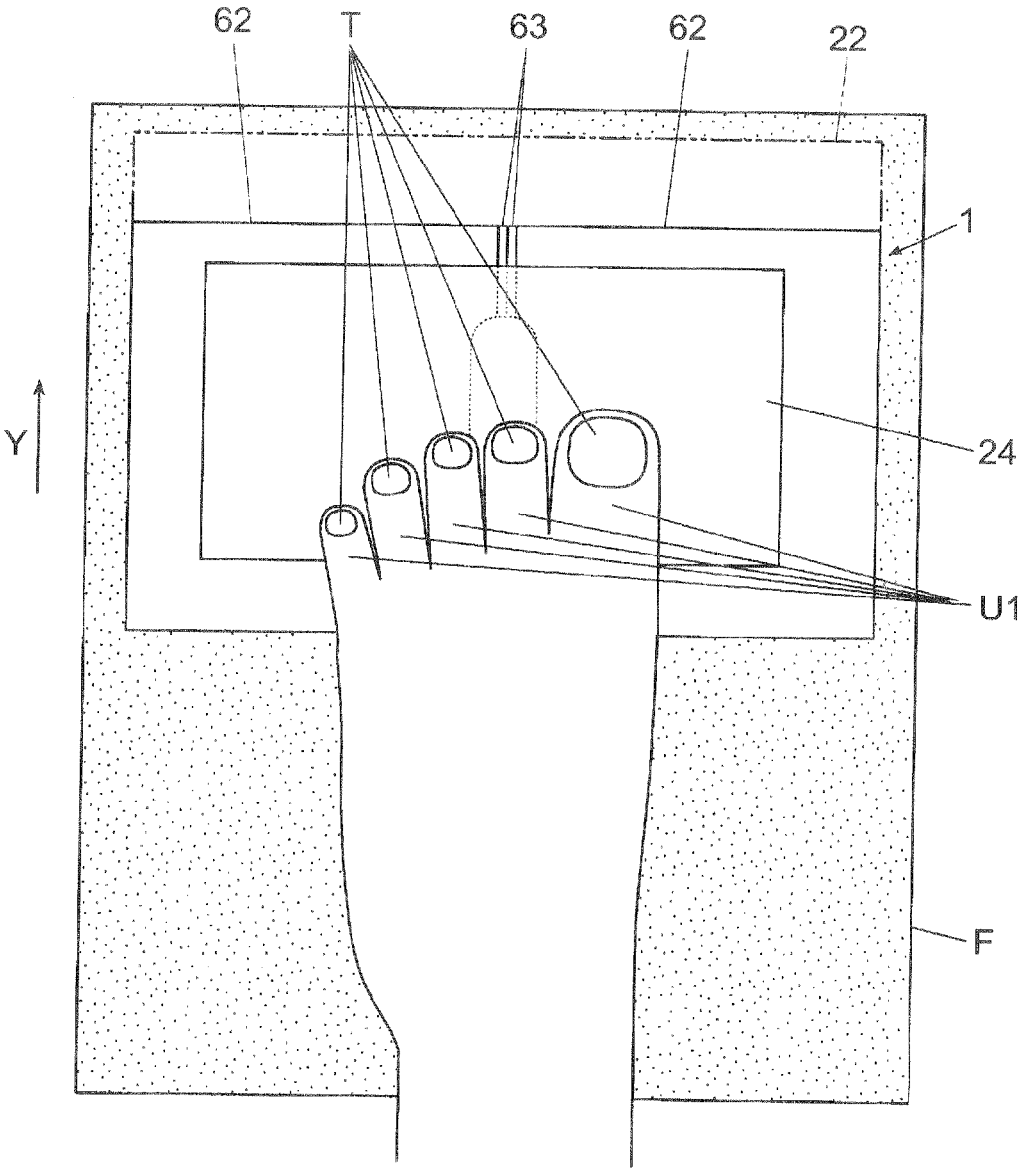
FIG. 8 is a plan view, viewed from the above, of the printing finger/toe insertion section of FIG. 7.

In performing printing on the nails T of toes with the nail print apparatus 1, the nail print apparatus 1 is placed on a floor surface F with the legs 6 being in the unextended state where the legs 6 are folded up into the print apparatus body 2, as shown in FIGS. 7 and 8. That is, printing is performed on the nails T of toes with the legs 6 being in the unextended state without creating the second insertion section 60. This reduces the height of the printing finger/toe insertion section 23 from the floor surface, and as a result, toes can be inserted in the printing finger/toe insertion section 23 without lifting the foot off the floor surface F.

The five toes are inserted as printing fingers/toes U1 into the printing finger/toe insertion section 23 from the insertion opening 231 of the nail print apparatus 1, with the auxiliary holder 25 stored in the printing finger/toe holder 24. Since the printing finger/toe holder 24 is disposed above the level of the bottom surface of the print apparatus body 2 from the floor surface F, the tips of the toes, i.e., the nails T are placed at a higher position closer to the print head 46 (see FIG. 7) when the five toes are inserted in the printing finger/toe insertion section 23, which is suitable for printing. In this case, the foot inserted in the printing finger/toe insertion section 23 is stably fixed since the heel is on the floor surface F. In this state, the print section 40 performs printing operation to print the design image on the nails T of the toes.

As described above, the nail print apparatus 1 according to the present embodiment includes legs 6 which can be folded up into the print apparatus body 2 and can be extended below the printing finger/toe insertion section 23. The legs 6 in the extended state create a space constituting the second insertion section 60 (i.e., the space where non-printing fingers U2 are inserted) below the printing finger/toe insertion section 23 where printing fingers/toes U1 are inserted.

Accordingly, the legs 6 are folded up into the print apparatus body 2 to reduce the height of the printing finger/toe insertion section 23 from the floor surface F in performing nail printing on the nails T of toes, while the legs 6 are extended below the first insertion section to create the second insertion section in performing nail printing on the nails T of fingers. As a result, fingers and toes can be placed at positions suitable for printing in performing nail printing on both fingernails and toenails. That is, nail printing can be performed on both fingernails and toenails with a simple structure.

In addition, since the height of the printing finger/toe insertion section 23 from the floor surface F is reduced in performing printing on the nails T of toes, a user can easily insert the toes into the printing finger/toe insertion section 23 with his/her heel on the floor surface F. As a result, the foot is stably supported and is prevented from moving and shaking during printing.

In addition, since the space for non-printing fingers U2 (i.e., the second insertion section 60) is not created when performing printing on the nails T of toes, a partition member provided between the printing finger/toe insertion section 23 and the space for non-printing fingers U2 (i.e., the printing finger/toe holder 24 and the bottom of the print apparatus body 2 in the present embodiment) does not need to have high intensity. More specifically, such intensity as to support inserted fingers is enough, and the partition member does not need to be strong enough to support a foot. This can reduce the weight of the apparatus 1 and simplify the structure of the apparatus 1.

In addition, since the legs 6 can be folded up into the print apparatus body 2 when the nail print apparatus 1 is not in use, the apparatus 1 can be downsized by folding up the legs 6 and therefore can be stored in a small space.

In addition, just folding up the legs 6 allows the nail print apparatus 1 to perform printing on toenails. Accordingly, it is not necessary to prepare a special holder for a foot, i.e., it is not necessary to prepare additional members. That is, nail printing can be performed on both fingernails and toenails with a simple structure without increasing the number of components.

Among fingers, there is a great difference between the length of a thumb and the lengths of the other four fingers. Further, there is also a great difference between the length of fingers and those of toes. For these reasons, if a printing finger/toe holder is designed to fit a long finger, it is generally difficult to insert the nails T of a short thumb and toes, as printing fingers/toes U1, deeply until the nails T reach the position under the print head 46. In contrast, the auxiliary holder 25 provided in the printing finger/toe holder 24 in the present embodiment eliminates such a problem. The auxiliary holder 25 can be in the stored state where the auxiliary holder 25 and the printing finger/toe holder 24 overlap each other, and can be in the projecting state where the auxiliary holder 25 projects in the direction opposite to the finger/toe insertion direction Y. The auxiliary holder 25 is brought into the projecting state so as to support printing fingers/toes U1 in performing printing on the nails T of relatively-long fingers (i.e., index, middle, ring and little fingers); while the auxiliary holder 25 is brought into the stored state so as to support printing fingers/toes U1 with the printing finger/toe holder 24 in performing printing on the nails T of a thumb and toes. In this way, the nails T can be appropriately disposed at positions suitable for printing in accordance with the lengths of fingers/toes.

The legs 6 which create the second insertion section 60 in the present embodiment can easily be folded up because one end of each leg 6 is rotatably attached to the bottom of the print apparatus body 2 with the hinge 61. Therefore, in accordance with fingers/toes to be printed, the state of the legs 6 can be easily switched between the unextended state where the legs 6 are substantially parallel with the bottom and the extended state where the legs 6 extend in the direction perpendicular to the bottom.

Second Embodiment

Figure 9:
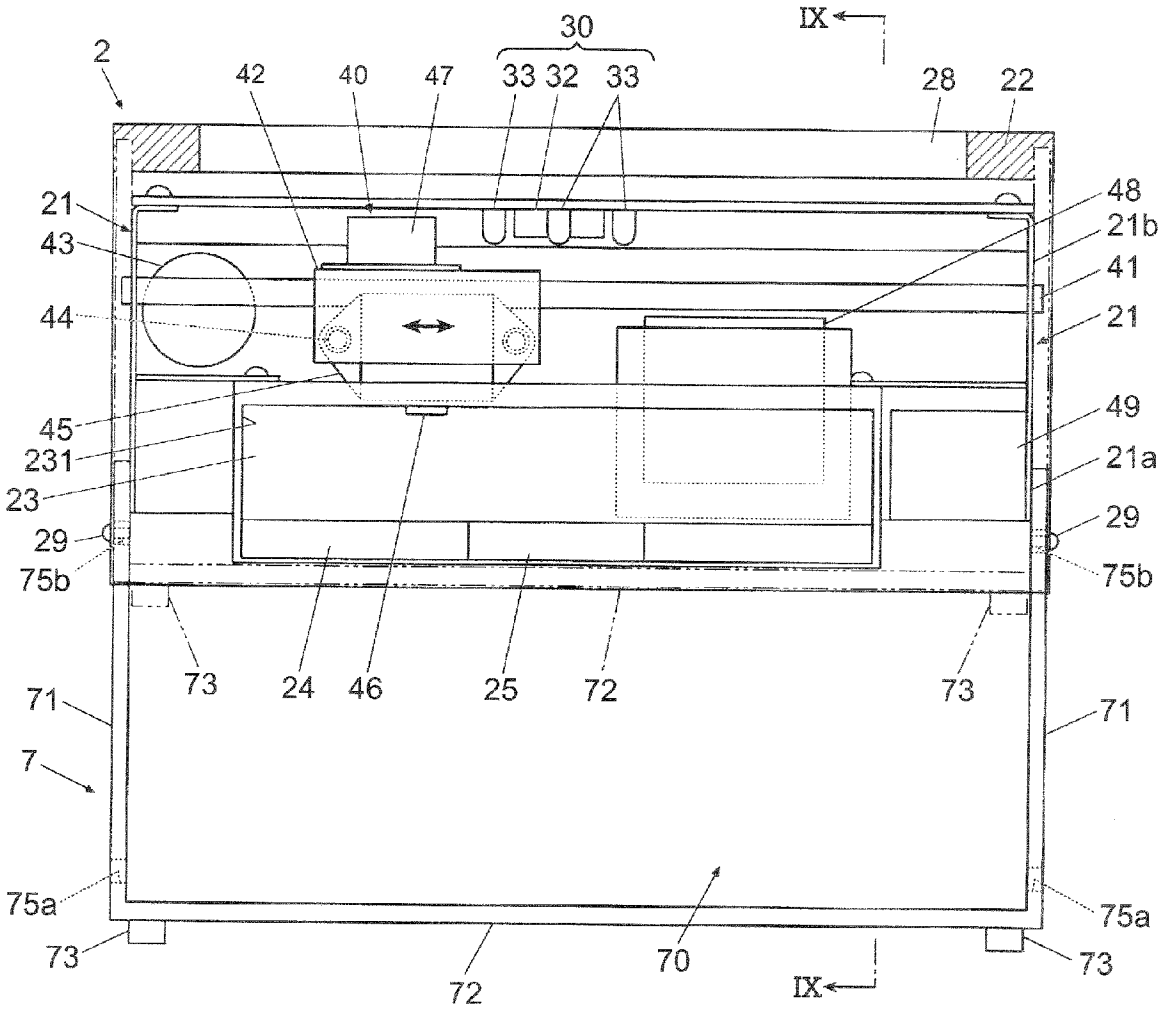
FIG. 9 is a cross-sectional view, viewed from the front, of a nail print apparatus according to a second embodiment.
Figure 10:
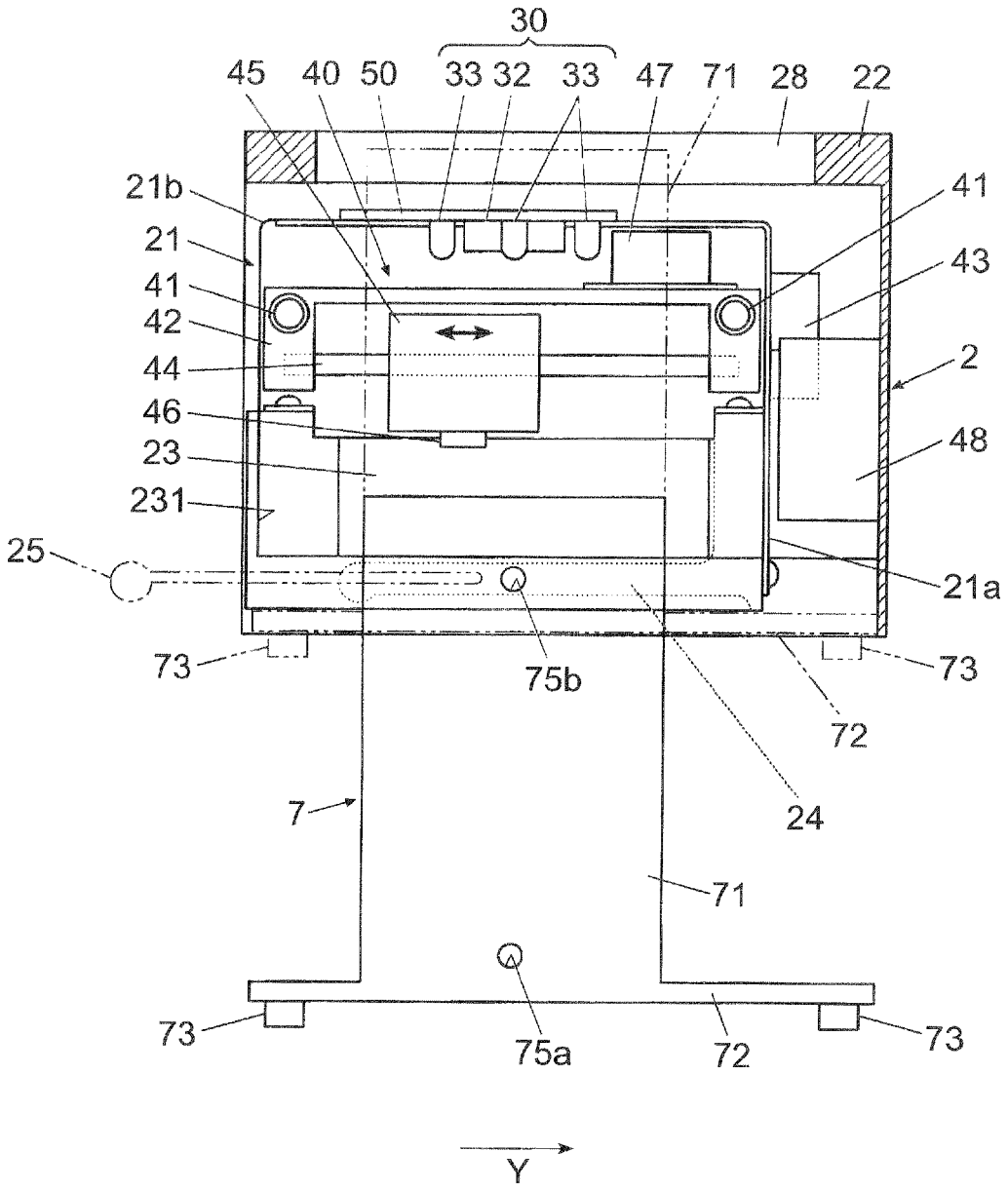
FIG. 10 is a cross-sectional view, along the line IX-IX, of the nail print apparatus shown in FIG. 9 according to the second embodiment.

Next, a second embodiment of a nail print apparatus according to the present invention is described with reference to FIGS. 9 and 10. FIG. 9 is a cross-sectional view, viewed from the front, of the nail print apparatus according to the second embodiment. FIG. 10 is a cross-sectional view, along the line IX-IX, of the nail print apparatus shown in FIG. 9 according to the second embodiment. The second embodiment is different from the first embodiment only in the structure of the legs. Therefore, the following description is focused on the difference between the embodiments.

As shown in FIGS. 9 and 10, the nail print apparatus of the second embodiment includes a print apparatus body 2 and a leg 7, and the print apparatus body 2 includes a machine casing 21 and a case 22 containing the machine casing 21, similarly to the first embodiment.

In the second embodiment, the leg 7 is movable up and down along the both sides of the print apparatus body 2. The leg 7 can be in an unextended state where the leg 7 overlaps the both sides of the print apparatus body 2, and can be in an extended state where the leg 7 extends downward below the both sides of the print apparatus body 2. In the extended state, the leg 7 creates a second insertion section 70.

More specifically, the leg 7 includes a pair of leg plates 71 provided along the both sides of the print apparatus body 2, and a bottom plate 72 connecting the leg plates 71.

In the second embodiment, the print apparatus body 2 has recesses or slits at its both sides where the leg plates 71 can be inserted. The leg plates 71 are slidable in the recesses or slits. When the leg plates 71 are inserted in the recesses or slits, the leg plates 71 lie almost in the same plane as the both side surface of the print apparatus body 2.

Locking pins 29 are provided on the both side surfaces, respectively, of the print apparatus body 2 of the second embodiment. Each of the locking pins 29 is biased outward with a spring or the like such that each of the locking pins 29 can project and retract. Each of the leg plates 71 has two locking holes 75*a* and 75*b* corresponding to the respective locking pins 29. When the locking pin 29 fits in the locking hole 75*a* disposed at the lower part of each leg plate 71, the leg 7 gets into the unextended state where the leg plates 71 overlap the both sides of the print apparatus body 2 and where the bottom plate 72 overlaps the bottom of the print apparatus body 2. When the locking pin 29 fits in the locking hole 75*b* disposed at the upper part of each leg plate 71, the leg 7 gets into the extended state where the leg plates 71 are extended downward below the both sides of the print apparatus body 2.

On the back surface (bottom surface) of the bottom plate 72, shock-absorption members 73 made of resin or the like are provide. The shock-absorption members 73 prevent a desk or a floor from being damaged when the nail print apparatus 1 is placed on the desk or the floor. These shock-absorption members 73 also serve as non-slip members to prevent the nail print apparatus 1 from moving when printing fingers/toes U1 and non-printing fingers U2 are inserted in or pulled out of the apparatus 1 at the time of printing. The positions at which the shock-absorption members 73 are provided are not limited to the example shown in the drawings. In addition, providing the shock-absorption members 73 is optional and may be omitted.

Since the other structures are the same as those of the first embodiment, the same numbers or alphabets are assigned to the same components between the embodiments and repetitive explanations are omitted.

Next, the behavior of the nail print apparatus in the second embodiment is described.

In performing printing on nails T of fingers with the nail print apparatus 1, a user first slides the leg 7 downward below the print apparatus body 2 while pressing the locking pins 29 inward and fits the locking pins 29 in the locking holes 75*b* to put the leg 7 into the extended state. This creates a space below the printing finger/toe insertion section 23, which space constitutes the second insertion section 70 where non-printing fingers U2 are inserted.

The method of performing printing on the nails T of a thumb and the other four fingers (i.e., index, middle, ring and little fingers) is the same as that of the first embodiment. Therefore, the repetitive explanations are omitted.

In performing printing on nails T of toes with the nail print apparatus 1, a user places the nail print apparatus 1 on a floor surface F with the leg 7 in the unextended state where the locking pins 29 fit in the locking holes 75*a* and where the leg 7 is inserted in the print apparatus body 2. This reduces the height of the printing finger/toe insertion section 23 from the floor surface F, and as a result, toes can be inserted in the printing finger/toe insertion section 23 without lifting the foot off the floor surface F.

The method of performing printing on the nails T of five toes is the same as that of the first embodiment. Therefore, the repetitive explanations are omitted.

As described above, the nail print apparatus 1 according to the second embodiment brings about not only the advantageous effects obtained in the first embodiment but also the following effects.

Specifically, the leg 7 to create the second insertion section 70 in the second embodiment is disposed at the both sides of the print apparatus body 2 in such a way that the leg 7 is movable up and down along the both sides. The leg 7 can easily switch its state between the unextended state, where the leg 7 overlaps the both sides of the print apparatus body 2, and the extended state, where the leg 7 extends downward below the both sides of the print apparatus body 2, simply by sliding the leg 7 up and down. This enables creation of the second insertion section 70 and printing for various printing fingers/toes U1 with a simple structure.

In addition, the state of the leg 7 can easily be switched between the unextended state and the extended state using the locking holes 75*a* and 75*b* and the locking pins 29 to fit in the holes 75*a*/75*b*. Specifically, merely switching a hole to be used between the holes 75*a* and 75*b* can switch the state of the leg 7. Accordingly, printing on both fingernails and toenails can be easily performed with one apparatus.

It should be understood that the present invention is not limited to the above-described embodiments but may be modified in various manners without departing from the spirit of the invention.

For example, although the leg 7 includes the pair of leg plates 71 provided along the both sides of the print apparatus body 2, and the bottom plate 72 connecting the leg plates 71 in the second embodiment, the structure of the leg 7 is not limited thereto.

For example, the bottom plate 72 may be omitted as long as the leg 7 includes the pair of leg plates 71. In this case, the length of each leg plate 71 in the finger/toe insertion direction Y (i.e., the width of each leg plate 71) may be about the same as the depth of the print apparatus body 2.

Further, a leg plate may be provided at the rear surface of the print apparatus body 2 in addition to the pair of leg plates 71. In this case, the leg plate at the rear surface and the pair of leg plates 71 may be connected such that these leg plates form a U shape.

Further, in the second embodiment, the shape and the structure of the both side surfaces of the print apparatus body 2 are not limited to the example described above. For example, the recesses/slits at both sides of the print apparatus body 2 may be omitted.

Further, the leg 7 may be locked on both side surfaces of the print apparatus body 2 at the positions of the unextended and extended states in a manner different from the method described above. For example, convex and concave portions may be provided on the sliding surfaces of both sides of the print apparatus body 2 and the sliding surfaces of the leg plates 71, respectively. In this case, when the leg plates 71 slide on both side surfaces of the print apparatus body 2, the leg plates 71 may be locked with these convex and concave portions engaged with each other.

Further, the leg 7 may be locked on both side surfaces of the print apparatus body 2 at three or more positions of different heights, instead of two positions. In this case, the leg 7 can be appropriately positioned at the most suitable height for a user depending on the size of a hand of the user, for example.

Further, the shape and the structure of the leg(s) are not limited to the examples shown in the first and second embodiments.

For example, the legs may be fold-up sticks. In this case, the legs are rotatably attached to the four corners of the bottom surface of the print apparatus body 2 with hinges. The legs are in the unextended state when the legs are substantially parallel with the bottom surface of the print apparatus body 2; and the legs are in the extended state where a second insertion section is created when the legs are rotated to be almost orthogonal to the bottom surface of the print apparatus body 2.

Alternatively, a cover for covering the entire surface of the print apparatus body 2 may be provided, and the cover removed from the print apparatus body 2 may be placed under the print apparatus body 2 to serve a leg. In this case, the cover creates a second insertion section below the printing finger/toe insertion section 23 of the print apparatus body 2.

Further, the nail print apparatus 1 may be provided with a mechanism to tilt printing fingers/toes U1, which are inserted in the printing finger/toe insertion section 23, upward by pushing up the printing finger/toe holder 24 from below, for example. This allows the nails T of the printing fingers/toes U1 to be disposed at positions suitable for printing closer to the print head 46.

In the first and second embodiments, the nail print apparatus 1 can perform printing for four fingers at the same time. Alternatively, the present invention may be applied to an apparatus that performs printing for fingers one by one inserted therein.

The present invention is not limited to the above-described embodiments. The present invention includes the scope of the claims and the equivalents thereof.

According to an aspect of the preferred embodiments of the present invention, there is provided a nail print apparatus including: a print apparatus body including: a first insertion section having an insertion opening from which a printing finger/toe is inserted, and a print head which performs printing on a nail of the printing finger/toe inserted in the first insertion section; and a leg which is extendable below the first insertion section and creates a second insertion section in an extended state.

Preferably, a non-printing finger is inserted in the second insertion section, the non-printing finger including at least one of a finger with a nail which is to be printed in the first insertion section but has not yet been printed, a finger with a nail which has already been printed in the first insertion section, and a finger with a nail which is not to be printed in the first insertion section.

Preferably, one end of the leg is attached to a bottom of the print apparatus body with a hinge; and the leg can be in an unextended state where the leg is substantially parallel with the bottom, and can be in the extended state where the leg extends in a direction perpendicular to the bottom.

Preferably, a shock-absorption member including resin is provided on a bottom surface of the print apparatus body.

Preferably, one of a recess and an opening to store the leg is provided in the bottom of the print apparatus body.

Preferably, a shock-absorption member including resin is provided on a lateral surface of the leg, the lateral surface constituting a bottom surface of the print apparatus body when the leg is in the unextended state.

Preferably, the leg is movable up and down along both sides of the print apparatus body; and the leg can be in an unextended state where the leg overlaps the both sides of the print apparatus body, and can be in the extended state where the leg extends downward below the both sides of the print apparatus body.

Preferably, a bottom of the first insertion section serves as a printing finger/toe holder; and the printing finger/toe holder includes an auxiliary holder which can be in a stored state where the auxiliary holder and the printing finger/toe holder overlap each other, and can be in a projecting state where the auxiliary holder projects in a direction opposite to an insertion direction of the printing finger/toe.

Preferably, the print head performs printing on the nail of a printing finger in the extended state, and performs printing on the nail of a printing toe in the unextended state.

The entire disclosure of Japanese Patent Application No. 2012-061688 filed on Mar. 19, 2012 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A nail print apparatus comprising:

a print apparatus body including:

a first insertion section having an insertion opening from which a printing finger/toe is inserted, and a print head which performs printing on a nail of the printing finger/toe inserted in the first insertion section; and a leg which is extendable below the first insertion section, wherein the leg can be in an unextended state in which the leg is substantially parallel with a bottom of the print apparatus body and can be in an extended state in which the leg extends in a direction perpendicular to the bottom of the print apparatus body, and wherein the leg creates a second insertion section in the extended state.

2. The nail print apparatus according to claim 1, wherein a non-printing finger is inserted in the second insertion section, the non-printing finger including at least one of a finger with a nail which is to be printed in the first insertion section but has not yet been printed, a finger with a nail which has already been printed in the first insertion section, and a finger with a nail which is not to be printed in the first insertion section.

3. The nail print apparatus according to claim 1, wherein one end of the leg is attached to the bottom of the print apparatus body with a hinge.

4. The nail print apparatus according to claim 1, wherein a shock-absorption member comprising resin is provided on a bottom surface of the print apparatus body.

5. The nail print apparatus according to claim 1, wherein one of a recess and an opening to store the leg is provided in the bottom of the print apparatus body.

6. The nail print apparatus according to claim 1, wherein a shock-absorption member comprising resin is provided on a lateral surface of the leg, the lateral surface constituting a bottom surface of the print apparatus body when the leg is in the unextended state.

7. The nail print apparatus according to claim 1, wherein a bottom of the first insertion section serves as a printing finger/toe holder; and wherein the printing finger/toe holder includes an auxiliary holder which can be in a stored state in which the auxiliary holder and the printing finger/toe holder overlap each other, and can be in a projecting state in which the auxiliary holder projects in a direction opposite to an insertion direction of the printing finger/toe.

8. The nail print apparatus according to claim 1, wherein the print head performs printing on the nail of a printing finger with the leg in the extended state, and performs printing on the nail of a printing toe with the leg in the unextended state.

9. A nail print apparatus comprising:

a print apparatus body including:

a first insertion section having an insertion opening from which a printing finger/toe is inserted, and a print head which performs printing on a nail of the printing finger/toe inserted in the first insertion section; and a leg which is extendable below the first insertion section and creates a second insertion section in an extended state;

wherein the leg is movable up and down along both sides of the print apparatus body; and wherein the leg can be in an unextended state in which the leg overlaps the both sides of the print apparatus body, and can be in the extended state in which the leg extends downward below the both sides of the print apparatus body.

10. The nail print apparatus according to claim 9, wherein the print head performs printing on the nail of a printing finger with the leg in the extended state, and performs printing on the nail of a printing toe with the leg in the unextended state.

* * * * *